United States Patent [19]

Thiery

[11] Patent Number: 4,858,705

[45] Date of Patent: Aug. 22, 1989

[54] ASSEMBLY FOR MAKING ORIENTED BORE-HOLES

[75] Inventor: Jean Thiery, Le Pecq, France

[73] Assignee: Institut Francais Du Petrole, Cedex, France

[21] Appl. No.: 176,452

[22] Filed: Apr. 1, 1988

Related U.S. Application Data

[63] Continuation of Ser. No. 860,472, May 7, 1986, abandoned.

[30] Foreign Application Priority Data

May 7, 1985 [FR] France ..... 85 07069

[51] Int. Cl.[4] ..... E21B 7/08; E21B 47/024

[52] U.S. Cl. ..... 175/73; 175/45; 175/61

[58] Field of Search ..... 175/73, 75, 61, 62, 175/74, 76, 45, 107, 24, 26; 464/18, 20, 138

[56] References Cited

U.S. PATENT DOCUMENTS

| | | | |
|---|---|---|---|
| 2,672,321 | 3/1954 | Zubin | 175/75 |
| 3,382,938 | 5/1968 | Williams | 175/76 X |
| 3,667,556 | 6/1972 | Henderson | 175/73 |
| 3,903,974 | 9/1975 | Cullen | 175/73 X |
| 4,143,722 | 3/1979 | Driver | 175/73 X |
| 4,436,168 | 3/1984 | Dismukes | 175/61 X |

FOREIGN PATENT DOCUMENTS

| | | | |
|---|---|---|---|
| 865955 | 5/1978 | Belgium . | |
| 623157 | 7/1961 | Canada | 175/73 |
| 3306405 | 8/1984 | Fed. Rep. of Germany . | |

OTHER PUBLICATIONS

"Recents Developpements en Forage Teleguide", R. Desbrandes et al., *Revue del' Institut Francais du Petrole*, vol. 38, No. 1, Jan. 1983, pp. 63–81.

*Primary Examiner*—Jerome W. Massie, IV
*Assistant Examiner*—David J. Bagnell
*Attorney, Agent, or Firm*—Antonelli, Terry & Wands

[57] ABSTRACT

An assembly for driving a drilling tool in rotation about an axis related to the drilling tool from a drive column, rotating at its lower end about a second axis, with the axes being substantially convergent at the same point and forming therebetween an angle alpha. The assembly comprises in combination a remote controlled deflector adapted for creating a deviation of an angle alpha, a controller for controlling the value of the angle alpha, a guide for rotating a drilling tool and the drive column at its lower end about the axes relatively to the deflector and a controller for controlling the polar position of the deflector relatively to second axis.

17 Claims, 4 Drawing Sheets

ASSEMBLY FOR MAKING ORIENTED BORE-HOLES

This is a continuation of application Ser. No. 860,472, filed May 7, 1986 now abandoned.

BACKGROUND OF THE INVENTION

1. FIELD OF THE INVENTION

The present invention relates to an assembly for making oriented bore holes.

One of the objectives of the assembly of the present invention is to allow drains to be formed from existing or drilled vertical wells which are horizontal or inclined with precisely controlled orientation and which are connected to the vertical well by a section having a small radius of curvature (20 to 30 meter).

2. DESCRIPTION OF THE PRIOR ART

The above objective cannot be obtained by any existing system, whether operational or experimental. The conventional horizontal bore hole using conventional drilling pipes involves transitional profiles from the vertical section to the horizontal section which are developed over several hundreds of meters. The drill hole with small radius of curvature using thick articulated drilling pipes does not allow the orientation of the horizontal drain to be controlled efficiently and with precision.

U.S. Pat. Nos. 2,198,016 and 1,850,403 as well as Belgian patent No. BE-A-865,955 and German patent No. DE-A-3,306,405 in addition to an article entitled "Recent developements in forage teleguide", "Révue del'Institut Francais du Petrole", Vol. 38, No. 1, January–February 1983, pages 63–81 provide examples of prior art proposals.

The present invention may be preferably used for forming horizontal drains in shallow oil reservoirs where the horizontal bore is technically or economically inapplicable due to, for example, numerous heavy oil deposits and bituminous sands, or for reactivating old existing oil wells which are no longer productive because of encroachment of, for example, water or gas or due to relative exhaustion. The advantage of this application, with respect to the current solution of boring intermediate vertical wells, increases the depth of the deposits.

It is also possible to utilize the present invention for constructing horizontal drains in the central zone directly below off-shore production drilling where access is not possible, as well as for increasing the rate of working deposits with multiple superimposed horizons by successively working the different horizons through horizontal drains drilled from a single vertical well.

Additionally, the present invention may be utilized for constructing drains following the sinuosities of mineral veins, which are thin and substantially horizontal in, for example, situ lixiviation or situ coal distillation.

The present invention also allows multiple drains to be bored in several directions from a common vertical access well.

SUMMARY OF THE INVENTION

To attain these objectives, the present invention uses an assembly for rotating a tool about an axis related to the tool from a column, called a drive column, rotating at its lower end about a second axis, with the axes being substantially convergent at the same point A and forming therebetween an angle alpha.

This assembly is characterised in that it comprises in combination a deflector or bend, adapted for creating a deflection through angle alpha, means for controlling the value of angle alpha, guide means for rotating the tool and the column at its lower end about the axes relatively to the deflector and means for controlling the polar position of the deflector relatively to said second axis.

When drilling from the surface, the means for controlling the polar position of the deflector may comprise a measuring probe integral with the deflector, the probe being referenced angularly relatively thereto, a second column called a polar orientation column interlocked in orientation with the deflector rising as far as the surface, the lower part of the orientation column being flexible.

In the case where the deflector is remote-controlled electrically and where the probe delivers electric signals, the polar orientation column may comprise centrally an electric conductor adapted for transmitting the measurement signals from the probe to the surface and the remote control signals from the surface to the deflector.

The drive column may comprise a flexible lower part whose lower end may be extended by a flexible extension and be fixed to the tool. The flexible part of the column may be coaxial with and external to the flexible section of the polar orientation column.

The drive column and the polar orientation column may each comprise a substantially rigid portion and the substantially rigid portions may be coaxial with and connected to the surface, the substantially rigid portion of the drive column may be connected at the surface to a rotary head.

The drive column may be connected to a bottom motor, with the bottom motor being a multilobe helical volumetric motor whose external rotary body is connected to the drive column and whose non rotary internal body is integral at its lower part with the flexible orientation column and at its upper part with the rigid upper portion of the polar orientation column. The flexible portion of the drive column may comprise a perfectly smooth internal wall and an external wall having at least one rib wound in the form of a helix.

The deflector may comprise two bodies articulated to each other about a shaft or bowl joint, the upper body forming an extension of the measuring probe and of the orientation column, the lower body supporting the rotational pivoting assembly for the drilling tool and means adapted for controlling the angle formed between the bodies.

The means for controlling the angle formed between the two bodies may comprise a screw jack which adjusts the distance between a first point belonging to the lower body and a second point belonging to the upper body.

The measuring probe may be placed inside a centering module adapted for maintaining the longitudinal axis of the probe substantially parallel to the mean axis of the well at its level.

The measuring probe may be placed inside an internal centering body integral towards the top with the base of the flexible orientation column and towards the bottom with the upper body of the deflector.

The internal centering body may be placed coaxially inside an external centering body, itself being possibly centred and aligned in the well by lower and upper centering shoes.

The external centering body may be integral at the top part with the foot of the main flexible couplings, and connected at the lower part to the drilling tool through an assembly forming a drive spacer comprising a flexible rotary seal.

Centering and alignment of the internal centering body inside the external centering body and centering of the drive spacer about the lower and upper bodies of the deflector may be provided by at least three radial pivoting assemblies.

The longitudinal thrust and tractive forces between the main flexible coupling and the drilling tool may be translated through the central core formed by the internal centering body and the deflector and two axial pivoting assemblies disposed respectively at the head and at the foot of the central core.

Appropriate ducts at the foot of the main flexible coupling, as well as a flexible bellows insulation about the deflector may be provided so that the flow of the drilling sludge between the head of the centering module and the tool takes place solely in the central part of the device, and so that the radial and axial pivoting assemblies work in an appropriate medium and are lubricated by oil.

The assembly of the present invention may comprise orientation means situated at the surface at the upper end of the orientation column.

Thus, the present invention very often requires the use of a lower flexible column only over a length limited to the development of the horizontal drain and of the curved connection to the vertical section of the well.

The connection between the lower flexible column and the surface, through the vertical section of the well, may be provided by conventional rigid drill pipes.

In accordance with the present invention, it is possible to measure the directional parameters of the drain continuously during drilling at a very small distance behind the drilling tool.

According to the present invention, the possibility of placing, immediately behind the drilling tool, which is precise, has wide deflection and is continuously controllable remotely from the surface, allows perfect mastery of the path of the tool and therefore good mastery of the profile of the drilled well.

In addition, with the present invention the potential difficulties inherent in all horizontal boreholes may be faced in security, easily and essentially using normal methods such as drilling under limit pressure balance, infiltration of pressurised fluids, flow losses, differential sticking, and jamming.

Finally, the present invention allows the thrust and torque transmission from the vertical section of the lining to the drilling tool to be optimized through the lower flexible riser.

BRIEF DESCRIPTION OF THE DRAWINGS

The present invention will be better understood and its advantages will be more readily understood from the following description of a particular embodiment, which is in no way limitative, illustrated by the accompanying drawings.

DESCRIPTION OF THE PREFERRED EMBODIMENTS

Figure 1:
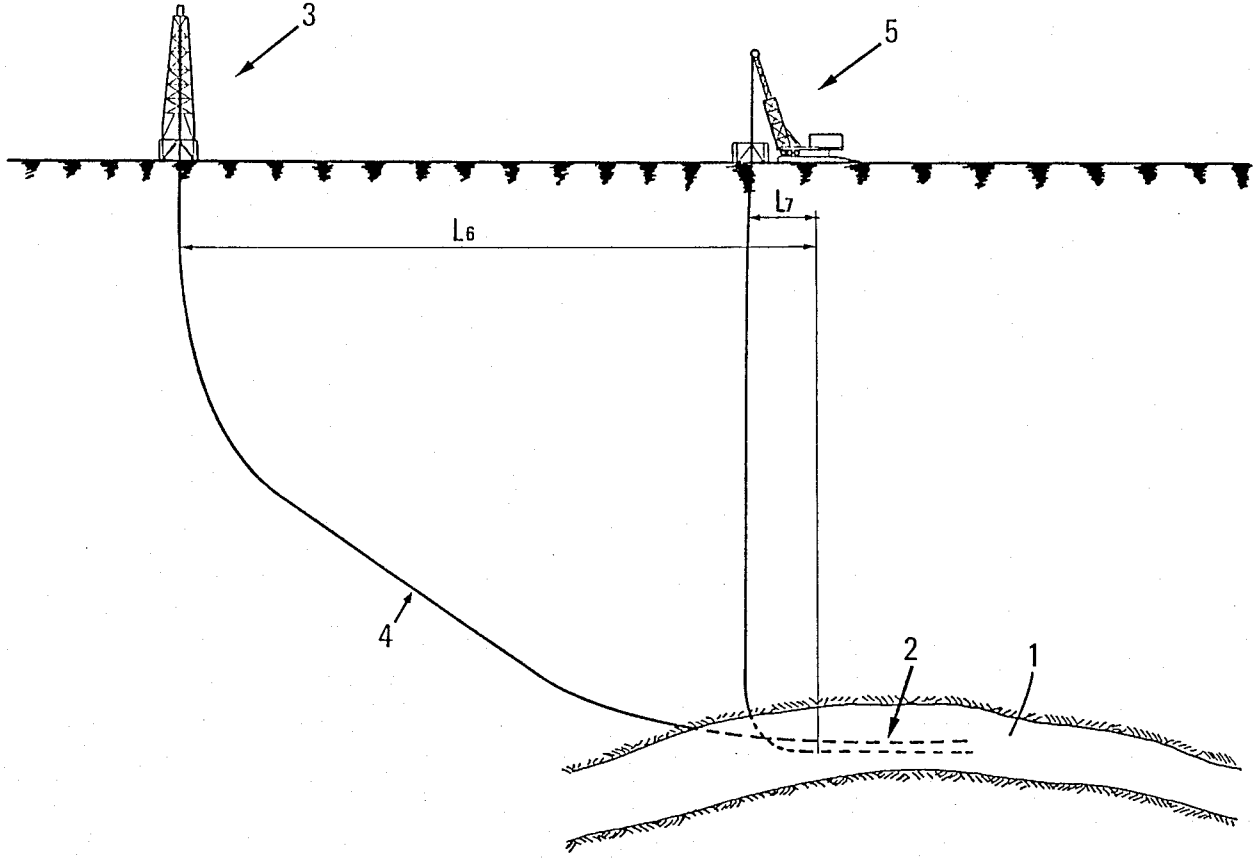
FIG. 1 compares the profile of a well drilled using the usual conventional techniques and the profile of a well drilled using the techniques of the present invention, these two wells being intended for positioning a horizontal drain in the same geological formation.

In FIG. 1, reference 1 designates the geological formation in which a horizontal drain 2 is to be drilled.

With the present invention the radius of curvature of the path of the drilled well may be controlled at all times and thus provides numerous advantages, as was outlined above.

In FIG. 1, the distance L6 designates the distance separating the surface well 3 from the point straight above the horizontal drain to be drilled when using usual conventional drilling techniques.

Distance L7 designates the same distance when using the assembly of the present invention.

It can be seen without any possible ambiguity that the distance L7 is very much less than the distance L6 and that the surface well 5 used for putting into practice the assembly of the present invention is practically straight above the beginning of the horizontal drain.

Independently of this advantage, the present invention provides accurate control of the path of the drill-hole and allows it to be rectified practically instantaneously with a minimum delay, through the control and mastery at all times of the positioning of the tool in the well. In addition, with the present invention, the radius of curvature of the path of the drilled well may be varied over a wide range.

After conventional drilling and cubing of the vertical part of the well (or from the bottom of an existing well, by side-tracking) the curved drill-hole, then horizontal, is formed by a conventional tool driven in rotation and receiving a thrust from the lining or vertical column, through the lining or lower flexible column. The vertical column may be rigid.

Figure 7:
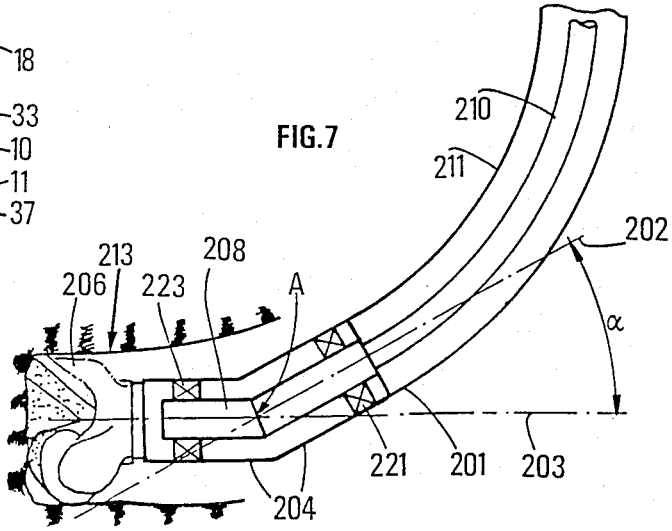
FIG. 7 shows schematically a simple embodiment of the present invention.

In FIG. 7, reference 213 designates the drilled well, reference 206 the drilling tool.

The lower end 201 of a drive column 211 rotates about an axis 202 and rotates tool 206 about an axis 203 through a flexible sleeve or flexible joint 204.

This flexible joint forms an extension of the drive column. Axes 202 and 203 are substantially convergent at a point A and form there between a deflection angle alpha.

It is the deflector means 208 which provides the deflection of angle alpha.

Through guide means 221 and 223, tool 206 and the lower part 201 of the drive column 211 may be rotated respectively about axes 203 and 202 relatively to the deflector 208.

In the case of FIG. 7, the deflector is held against rotation by an orientation column 210.

Figure 2:
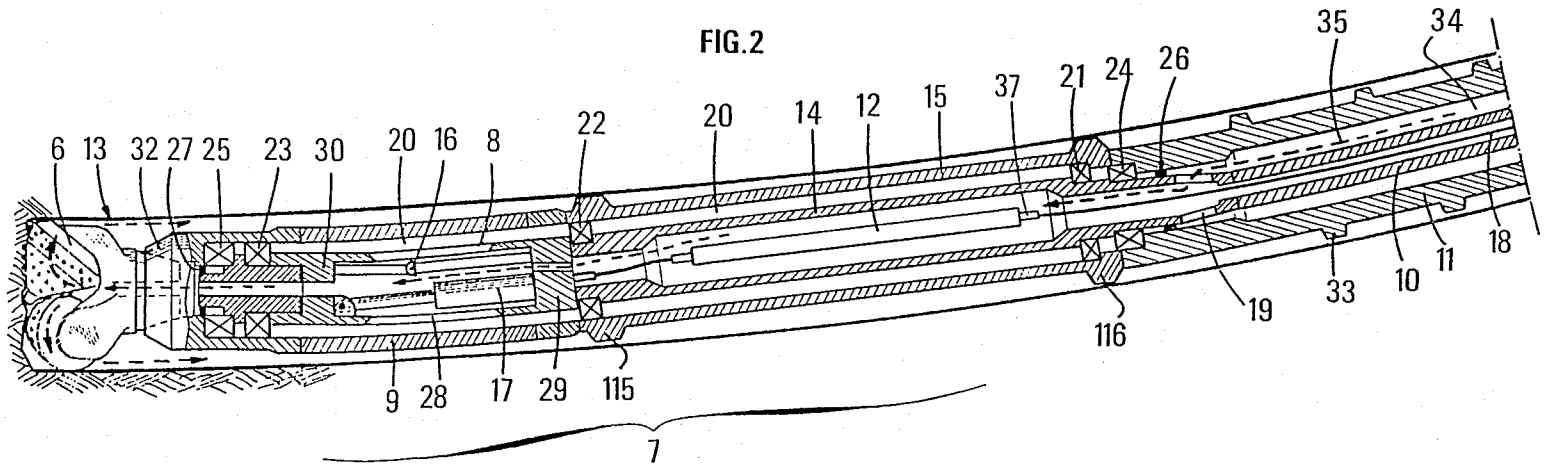
FIG. 2 shows in detail one embodiment of the assembly of the present invention.

In the example shown in FIG. 2, the reference 7 designates a deflection and measuring instrument. This instrument comprises a bend with variable angle or deflector 8 located inside the lower end of a flexible joint 9 forming a flexible extension of the drive column. Immediately behind tool 6, the radial or polar orientation of this bend 8 is controlled by a polar orientation column 10 flexible at least over its lower part. This column is substantially coaxial with the flexible joint 9, itself connected to a main flexible drive coupling 11, possibly extended as far as the surface by a rigid extension.

The assembly comprising the flexible joint, the main flexible drive coupling and the rigid extension form a riser for rotating the tool, similarly, the assembly comprising the flexible joint and the main flexible drive coupling may be considered as the flexible part of the drive column. However, in this case, when reference is made to the axis about which the lower end of the drive column rotates, it is the axis of the lower end of the main flexible coupling. The bend or deflector 8 allows radial deflections to be imparted to tool 6 in given controllable directions, resulting in different degrees of curvature or in the straightness of the well profile and control of its azimuth.

Instrument 7 also comprises a directional measurement probe 12 housed in the center of the orientation column, immediately behind the deflector 8 namely, about 2 to 3 meters behind the tool. With it, a short distance behind any drain section which has just been drilled, the inclination and azimuth of this section may be measured.

With this speed of response, the profile may be corrected if required without delay by adjusting the angle and the orientation of deflector 8. This rapid looping between the creation of hole 13, the measurement of its profile and the reaction on deflector 8 form one of the major innovations of the system with respect to other known horizontal drilling systems. It is that which opens up the possibility of forming profiles having small, possibly complex radii of curvature, and yet with precision, either for faithfully executing a given profile or for exploring the practical profile of a given layer.

The accuracy of directional measurement involves satisfactory centering of the measurement probe 12 in the hole, as well as a certain smoothing of undulations which are too short and without significance thereof. For this, the probe 12 is aligned in a rigid extension 14 of the orientation column 10. The ridged extension 14, which may be considered as an internal centred body, is itself centred in a module or centering body and external stabiliser 15 having a length of 3 to 4 meters, inserted between the main flexible coupling level and the deflector module 8. The external centering body 15 may comprise lower and upper centering shoes 115, 116.

In addition to the inclination and the azimuth of the profile of the drain, probe 12 may measure the radial or polar orientation of the deflector with respect to the top generatrix of the hole or with respect to the magnetic north (also called "tool face"), so that this radial orientation may be maintained or corrected, by acting at the surface on the orientation riser.

Probe 12 may comprise magnetometers for measuring the azimuth and the "tool face". These magnetometers must be spaced apart from appreciable magnetic masses. For this, the centering module 15 and the rigid extension 14 of the orientation riser may be made from an amagnetic metal.

One technological solution for the defector 8 is proposed and shown in FIG. 2 which uses an articulated knuckle joint 16 whose flexion or deviation controlled by highly stepped down electric jack 17. This fact, combined with the short lever arm of the deflector 8, means that the torque required of the motor of the jack to overcome the deflection forces is low and the power required for the motor is also low, and may be the order of a quarter of a kilowatt.

An electric cable which may be single conductor cable 18, located in the center of the orientation column 10 and its extension as far as the surface, transmits the electric power and the remote controls to the deflector 8 (discontinuous actions) and conveys the signals from the directional measuring probe 12 in digital mode to the surface for decoding and processing (continuous transmission). It is of course well-known to a man skilled in the art to make electric power and electric signal transfers using a single conductor.

The supply of drilling sludge for irrigating hole 6, washing the hole and balancing the formation pressures, takes place through the annular space between the external wall of the orientation column 10 and the internal wall of the main flexible coupling 11. Thus, the friction between these walls, during rotation of the main flexible coupling 11 about the orientation column 10, is lubricated friction.

Just upstream of the centering module 15, the flow of sludge is directed towards the center, inside the riser extension, through orifices 19 and is thus channelled to the center of tool 6. The annular space 20 about the column extension and deflector 8 is filled with oil which may be under the same pressure as the sludge using devices well known to a man skilled in the art. This oil provides efficient lubrication of the centering bearings 21, 22 and 23, and of the upstream 24 and downstream 25 axial abutments.

Upstream and downstream rotary seals 26 and 27 isolate the oil from the sludge. A semi-rigid metal membrane 28 connects the upstream 29 and downstream 30 elements of the knuckle joint 16 about deflector 8. The membrane 28 may be formed by a metal bellows. A flexible joint 9, resistant to the pressure differential between its internal face and its external face (equal to the pressure joint in the tool), connects the centering module 15 to the tool-holder endpiece 32.

The transmission of thrust from the main flexible coupling 11 to the tool-holder endpiece 32 may be provided preferably through the orientation riser extension 14 and deflector 8 through upstream 24 and downstream 25 axial abutments. Thus the flexible joint 9 will not have to support this thrust. It has however to support combined rotational, torque and flexural forces which generate fatigue effects. Consequently, this flexible joint 9 may be considered as a wearing part which must be replaced periodically. Of course, the axial abutment 24 may be placed substantially in the vicinity of the radial abutment 22. In this case, the transmission of the axial thrust to the tool will take place via the centering module 15 instead of via the extension 14 of the orientation column.

The main flexible coupling 11 has, among other functions, that of transmitting rotational, torque and axial thrust forces to tool 6 and to convey the drilling sludge to the bottom. It will have to allow removal to the surface of the sludge and of the excavated waste through the annulus of the hole.

This main flexible coupling will be preferably designed for minimising the risks of differential sticking, it will have to withstand the tractive force required for removing the lining of the drain possibly with combined rotation and circulation in the case of jamming and finally it will be preferably readily storable and transportable on the surface.

It may be formed of a (conventional) structure existing on the market and commercialised by the firm CO-FLEXIP. Such structures generally comprise and internal plastic tube, and seamed steel wire carcass with "Zeta" profile, an intermediate plastic sheath, two crossed layers of steel sheathing at a pitch of about 45°, and an external plastic sheath (Rilsan).

In a particular embodiment of the main flexible coupling 11, in accordance with the invention, it may comprise an external spiralled rib 33, made from polyamide strengthened with reinforcing fibres (aramide fibres, for example, the fibre called "Kevlar" produced by the firm Dupont de Nemours), placed at its periphery.

This rib 33, playing an essential role, fulfills multiple functions. More particularly, since its external diameter is close to that of the hole and of the last tubing or temporary guide tubing or liner in the vertical section of the weld, it ensures guiding of the flexible coupling 11 and avoids buckling thereof under compression when it transmits the thrust to the tool. By the screwing effect into the hole and into the sludge in a manner similar to that of an auger, it helps in transmitting the thrust of the ballast present in the vertical portion of the well and it generates a certain additional thrust itself.

The screwing effect also facilitates removal of the excavated waste by avoiding sedimentation thereof on the low generatrices of the hole and by inducing translation thereof towards the surface. It also contributes to maintaining the hole in an "open" states by its continuous boring effect.

Finally, the rib isolates the flexible coupling properly speaking from the hole and thus avoids the risks of differential sticking and the risks of damage to the external sheath of the flexible coupling 11 by abrasion or fouling.

On the other hand, since the rib is in permanent frictional contact with the walls of the hole and of the tubing, and despite its construction from polyamide reinforced with aramid fibers, wear resistant and with low friction coefficient, the rib will have a shorter lifespan than that of a flexible coupling proper and will have to be replace or strengthened periodically.

The main function of the flexible column 10 is to transmit the orientation torque from the surface to deflector 8 and to maintain this orientation during driling. Its diametrical dimensions must provide at its center a passage for the electric transmission cable 18 and, externally, an annular space 34 in the main flexible coupling 11 sufficient for passing therethrough the downward flow of drilling sludge, indicated by arrow 35.

It may be formed by a conventional and simple structure of the type commercialised by the firm CO-FLEXIP. It may comprise, more particularly, an internal carcass made from an internal seamed metal strip carcass, two crossed layers of steel sheathing with relatively short pitch (optimization of the resistance under torque), and an external casing.

This flexible coupling 10, installed permanently inside the main flexible coupling 11 will nevertheless be readily removable for inspection, maintenance and so as to provide if required access to the inside of the main flexible coupling 11 during operations such as, for example, for "back-off" above the bottom instrument.

It will be noted that the friction due to rotation of the main flexible coupling about the stationary orientation flexible coupling is that of a plastic material (such as the material commercialised under the trade mark Rilsan) on itself, with interpositioning of downward moving drilling sludge, not at all, or very little, charged with solid matter. Such friction, and the wear of the surfaces, are therefore low.

The electric transmission cable 18, possibly a single conductor cable, may be permanently installed in the center of the orientation flexible coupling.

The electric transmission cable 11, at the bottom thereof, is connected to the measuring probe 12, during assembly of the main flexible coupling 11 orientation flexible coupling 10 unit on the bottom instrument 7. At the top part thereof, the electric transmission cable 11 ends in connector 36, possibly a single contact connector, housed in the center of the combined main flexible coupling 11 and orientation flexible coupling 10 endpiece. The connection of cable 18 to probe 12 may be provided by a connection 37.

Figure 6:
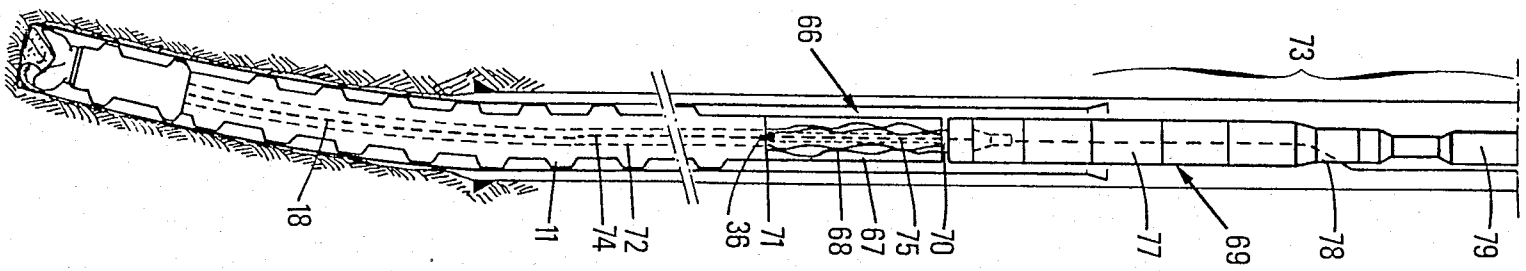
FIG. 6 shows another embodiment of the invention.
Figure 3:
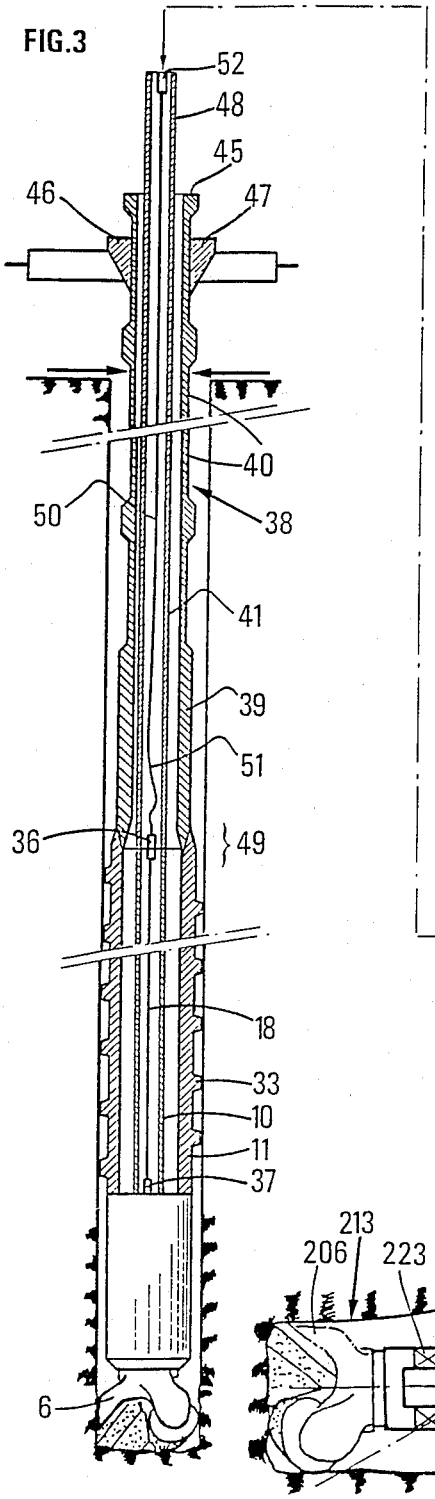
FIGS. 3 and 4 illustrate one method of rotating the tool by means of a rigid riser emerging at the surface.
Figure 4:
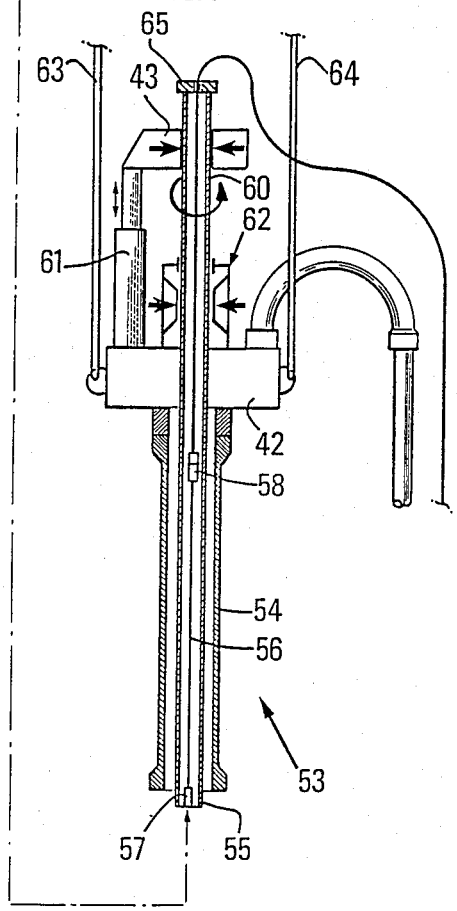

As for the column connection in the lining of the vertical section of the well, two lining systems may be considered, depending on the method of providing the rotation during drilling. These two embodiments are shown in FIGS. 3, 4 and 6.

If the movement for driving the tool comes from the surface (FIGS. 3 and 4), (this method is currently termed rotary drilling), the main flexible coupling 11 is extended as far as the surface by a main string 38, possibly rigid, formed possibly from stringer masses 39 and conventional drilling pipes 40. The orientation flexible coupling 10 may be extended in the center of the main stringer 38 by an orientation column 41, possibly rigid, formed of conventional drill pipes of mining type with constant external diameter, generally called "flush mining pipe" by a man skilled in the art.

The assembly comprising the orientation flexible coupling and the possibly rigid column forms the polar orientation column or more simply orientation column.

The rotation, and injection of drilling sludge, are provided by a conventional motorised head 42 or "power swivel" connected to the main stringer 38. At its center passes and extends the rigid orientation column 41 and 10 whose top is connected to an orientator 43 of the orientation riser, mounted on the frame of the motorised head 42.

The assembly of the above described liner at the beginning of drilling of the drain may be accomplished in the way described hereafter.

The pre-assembled bottom instrument and tool assembly is laid on chocks.

Figure 5:
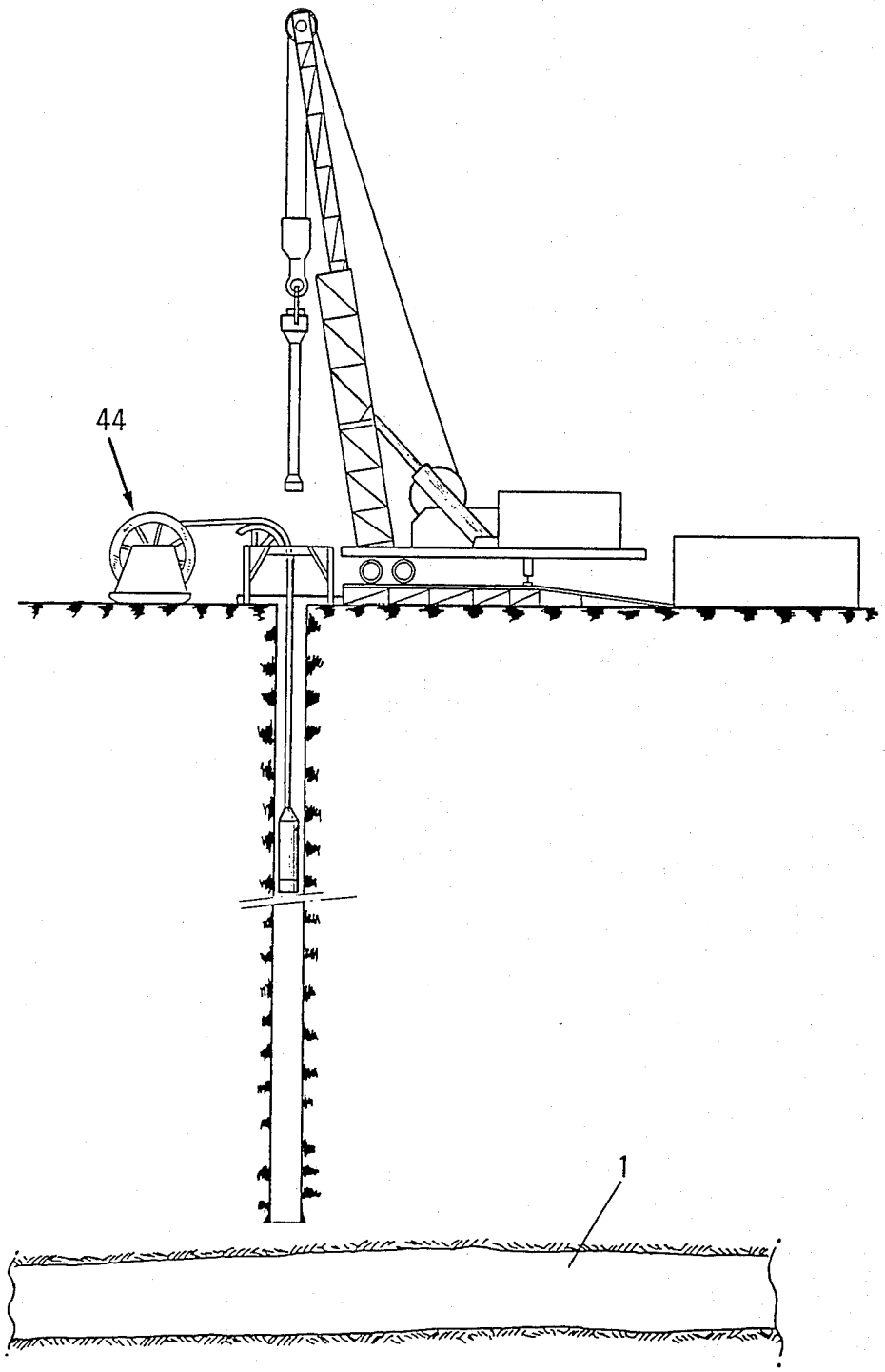
FIG. 5 shows one example of positioning the device of the present invention.

The main flexible coupling 11 orientation flexible coupling 10 central cable 18 assembly is connected to the bottom instrument 7, then lowered, by unwinding from the storage drum 44 (FIG. 5) of the flexible coupling assembly, until the upper combined endpiece is laid on chocks.

The pipe mass or masses 39 and main pipes 40 are then successively connected and lowered, until the tool is brought close to the datum level of the beginning of boring of the drain (bottom of vertical hole in the case of a "new" well; pre-formed lateral opening in the production tubing, in the case of a well "opened up again"). The last drill-pipe 45 added (at the top of the stringer) is laid on chocks 46, 47, its top extending above the chocks, for example, by 0.3 to 0.4 meter.

The flexible orientation column 10 is then extended as far as the surface by introducing, screwing and successively lowering sections of mining pipes with constant external diameter, generally called "flush" mining pipe by a man skilled in the art, and forming the upper orientation column 41 (setting for connections to a wedge box installed at the top of the main upper pipe).

The last orientation pipe 48 addition is accompanied by connection of the foot of the upper orientation riser 41 to the top of the flexible orientation coupling 10 through a simple square or hexagonal section sleeve joint at the level of reference 49. The length of the last pipe added is such that its coupling exceeds that of the upper main rod for example, by 0.3 to 0.6 meter.

The electric cable extension 50 is then introduced through the center of the column and lowered by unwinding. A plug which may be possibly a single-contact plug 36, at its foot, weighted by a load bar is connected, for example, by simple fitting at the end of lowering to the headplug of the flexible assembly. The total length of the cable may, depending on the depth of the well, be formed from several sub-sections, and may have an appreciable extra length with respect to the length of the rigid stringer.

This extra length is housed by sinusoid bend 51 in the lower part of the upper orientation riser 41, without any risk of damage by erosion since such flow is outside this orientation rise. It will be noted that, for the same reason, the problems of electric insulation, in particular at the connections by means of mono-contact plugs, are greatly facilitated.

In its upper part, the cable extension ends in a plug, possibly a mono-contact plug 52, which rests in a supporting endpiece at the top of the upper pipe of the orientation column.

At the beginning of drilling, then deepening thereof, follow the same procedure, using "added elements" 53 formed by sections of drill pipes 54 and mining pipes 55, paired in length, these latter being equipped with extension electric cable sections 56, mounted permanently and ending at each end in plugs, possibly monocontact plugs, 57 and 58, anchored in the ends of the mining pipe 55.

An assembly of two paired sections of main 54 and orientation pipes 55, is prepared in the rat hole, the bottom thereof being formed so that the mining pipe 55 is opposite upwardly with respect to the main pipe, for example by 0.2 meters.

The power swivel 42, with its endpiece screwed into the pipes and rotating the drilling stringer, is provided with an upper extension 60 of the orientation column 41, gripped in the tool face orientator 43, similar to a small size hydraulic clamping key. The orientator 43 is supported by an actuating cylinder 61 with vertical deflection which may be about 0.5 meter, itself anchored to the frame of the power swivel 42. A hydraulic-controlled backing 62 (of the snubbing lubricator type), above the power swivel, ensures sealing on the upper extension (polished chromium on the outside) of the orientation column.

The upper extension 60 of the orientation column is permanently equipped with the upper electric cable extension, ending at the lower part in a monocontact plug, and at the upper part in a rotary contact 65. Above this rotary contact, the surface cable follows the flexible sludge injection pipe and is connected to the surface equipment for receiving the measurements and remote controlling the deflector.

Thus equipped, the power swivel hooked on to the mobile polyblock by elevator arms 63 and 64 also termed "long links", is ready for operation.

The upper orientation column extension 60 is positioned for projecting under the end piece of the injection head, for example, by 0.1 meter, whereas the supporting cylinder is in the middle position. The injection head 42 is brought verticaly above the rat hole and is positioned by the pulley-block for situating the foot of the upper orientation column extension 60 above the mining pipe 50, for example, at 10 to 15 cm.

The upper extension 60 is then brought close to, engaged with and screwed into the mining pipe 50 by combining the rotation of the orientator 43 and the translation of its supporting cylinder 61, which provides a very fine approach and avoids the risks of damaging the threads of the mining pipes 55. The electric cable connection 56 is formed simultaneously. Tightening is achieved up to the maximum torque admissible for the threads, which torque may be automatically controlled by the orientator 43 or applied by spanners.

The jaws of the orientator 43 are then unclamped and moved away from the upper orientation column extension 60. The injection head 42 is lowered by the pulley block and the endpiece of the injection head is engaged with and screwed on to the main rod 54 by rotation of the head. Tightening may be achieved using conventional spanners.

The support cylinder 61 is in the top position.

The jaws of orientator 43 are clamped again on the upper extension 60.

The assembly of additional pipes 53 thus connected to the injection head is removed from the rat hole and brought by the pulley-block above the drilling stringer 38 waiting chocks 46, 47, while maintaining the space between the main pipe 45 on the chocks and the main added pipe 54, this space may be about 0.5 meter.

The upper extension 60 of the orientation column 41 is lowered and then brought close to the orientation column waiting in the drilling stringer 38 by actions of orientator 43 and of its support cylinder 61.

The orientator jaws are unclamped, and the main additional pipe 53 is brought close to and connected with the main stringer 38 on chocks 46, 47 by the actions of the pulley-block and of the injection head, tightening may be achieved by means of spanners.

The support cylinder 61 is positioned for positioning the orientation column 41 under tension under its own weight (slight sliding possible of the sliding sleeve joint at the riser foot). The backing 62 is closed on the upper orientation extension and drilling may begin.

The procedures for disconnecting the power swivel 42 after the first drilling pass and for the following additions, uses the same principles, reversed for the disconnections, as those described above.

The same goes for the removal of the added pipes 53 when raised and removed from the hole. It will be noted that each addition 53 may be made in sections of two or three pipes of 9 meters, i.e. 27 meters. There will then be eleven to eighteen additions to be made for a drain of 300 to 500 meters.

In another embodiment, the movement for driving the tool comes from a bottom motor (See FIG. 6).

Rotation of the main flexible coupling 11 is provided by a bottom motor 66, preferably of the volumetric type connected at the head of the flexible stringer 11. The motor 66 is used in the first position with respect to the conventional mode. It is the external body 67, normally the stator element, which is connected to the main flexible coupling 11 and which becomes the rotor or rotary element.

The main shaft 68, with lobes, becomes the stator element. The endpiece 70, normally the toolholder, of this central shaft 68 is in the upper position and is connected to the pipe mass 69 and conventional rod stringer rising to the surface.

The other end 71, normally free, of the central shaft 68 is connected to the orientation flexible coupling 72. This latter may then be orientated by action on the upper pipe stringer 73 which, apart from the orientation movements, remains angularly stationary. The central shaft 68 at the bottom motor as well as its extension in its pivoting assembly and its precessional, universal joints may be adapted for providing a central passage in which is housed an extension 75 of the electric transmission cable 74. This passage may be cylindrical and have a diameter of about ½.

Above the bottom motor 66 and this electric extension, the electrical connection to the surface is formed by a cable 77, having possibly a single conductor, connected at the low part to the extension 75 in the motor, by means of a plug, possibly a mono-contact, which may be weighted by a load bar.

The cable may be formed in several ways, namely, it may be single or continuous, of the wire line type, introduced through a side outlet connection 78, allowing addition of pipe 79 without handling the cable.

It may comprise a first cable section of adhoc length, introduced in the center of the assembled pipes when the tool is close to the bottom of the hole before drilling of the drain is begun, then a wireline type cable complement in the center of the pipes, connected to the preceding by possibly single contact block over which is mounted a loadbar, and leading the head of the pipe stringer through a backing, this cable complement then having to be handled during each addition. Thus, for example, for a drain length between 300 and 500 meters, the cable will have to be handled eleven to eighteen times in all if the additions are made in threes, with use of an injection head.

Instead of the cable complement, it is possible to use pipe elements grouped in threes for the additions, each group being equipped with a central cable with end plugs, possibly monocontact, permanently installed.

Of course, still within the scope of the present invention, each pipe element may be equipped with central cable with plug. The embodiment of the invention in which the movement for driving the drilling tool is of the rotary type, has certain advantages which are given hereafter relatively to the embodiment comprising a bottom motor.

The rotary drilling embodiment has a great flexibility in adapting the rotational speeds and the torques to the types of ground and the drilling conditions. There is no limit to the maximum torques than that imposed by the resistance limits of the pipes. So the capacity in fiting against intense frictional and jamming conditions is high.

Such an embodiment allows total independence of the mechanical parameters of the borehole and of the sludge pressure flowrates.

The whole of the electric connection between the bottom and the surface is freed from sludge which, in the embodiment termed rotary drilling, facilitates the provision and the maintenance of good electric insulation for the connections and eliminates the problems of erosion and damage to cables in the sludge stream.

The rotary embodiment avoids the problems related to the cable placed in the annulus of a well or to frequent cable handling.

In this embodiment, all the components of the system except for a few simple adaptations which however use elements known on the injection head, are quite conventional.

The embodiment of the invention termed rotary drilling allows, if required, in particular in the case of jamming impossible to overcome by rotation-traction-circulation, the central orientation column to be completely removed, including the flexible part, at the same time as the electric cable and the measuring probe, thus freeing the central of the main stringer as far as the deflector and allowing back-off shooting to be achieved and allowing the recovery of the major part of the stringer, including all or part of the main flexible connection, depending on the jamming level.

Finally, with this embodiment, in the case of flow loss, filling in products may be injected.

However, this embodiment has drawbacks relatively to the bottom motor version, which reside more specially in the relative complexity of the formation of the rigid drilling stringer as a whole and use thereof. This is however, moderated considering the simplicity, conventional nature and robustness of the individual components of this drilling stringer.

The embodiment of the present invention, which comprises a bottom motor, has advantages with respect to the so-called rotary version including more particularly that of simplicity of the formation of the rigid drilling stringer and of its use.

However, this bottom motor embodiment has limitations some of which are mentioned in the rest of this text.

Thus, the maximum torque which may be supplied by the bottom motor is necessarily limited. For example, with nine lobe motors, at present available on the market, no more than 400 to 500 mkg can be expected.

The above comparison leads to preferring the rotary motor when there is a choice.

What is claimed is:

1. An assembly for driving a drilling tool in rotation about an axis of said drilling tool from a drive column rotating at its lower end about a second axis, said axes being substantially convergent at the same point and forming therebetween an angle alpha, the assembly comprises in combination a remote-controlled deflector means for creating a deflection of the angle alpha, means for controlling a value of said angle alpha, guide means for allowing rotation of said tool and said drive column at a lower end about said axes relative to said deflector means, and means for controlling a polar position of said deflector means relative to the second axis whereby a rotation of said drive column effects rotation of said tool.

2. The assembly for drilling a borehole as claimed in claim 1, wherein said means for controlling the polar position of said deflector means comprises a measuring probe integral with said deflector means, said measuring probe being referenced angularly relatively thereto, a polar orientation column locked in orientation with said deflector means and extends as far as the surface, a lower part of said orientation column being flexible.

3. The assembly as claimed in claim 2, wherein the deflector means is remote-controlled electrically and wherein the measuring probe delivers electric signals, wherein said polar orientation column comprises at a center thereof an electric conductor means for transmitting measurement signals from the measuring probe to the surface and the remote control signals from the surface to the deflector means.

4. The assembly as claimed in claim 3, wherein the measuring probe is placed inside a centering module means for maintaining a longitudinal axis of the measuring probe substantially parallel to a mean axis of a well at its level.

5. The assembly as claimed in claim 2, wherein the drive column comprises a lower flexible part having a lower end extended by a flexible extension fixed to said drilling tool and said flexible part of said drive column is coaxial with and external to the flexible section of said polar orientation column.

6. The assembly as claimed in claim 5, wherein said drive column and said polar orientation column each comprise a substantially rigid portion and said rigid portions are coaxial and connected to the surface, the rigid portion of the drive column being connected at the surface to a rotary head.

7. The assembly as claimed in claim 5, wherein the flexible portion of said drive column comprises a perfectly smooth internal wall and an external wall having at least one spiralled rib.

8. The assembly as claimed in claim 2, wherein said drive column is connected to a bottom motor.

9. The assembly as claimed in claim 8, wherein said bottom motor is a multi-loop helical volumetric motor having a rotary external body connected to said drive column and an internal non-rotary body integral at a lower part thereof with the flexible portion of the orientation column and at a upper part thereof with the rigid upper portion of said polar orientation column.

10. The assembly as claimed in claim 2, wherein said deflector means comprises two bodies articulated with respect to each other about a ball joint means, an upper body forming an extension of the measuring probe and of the orientation column, a lower body supporting a pivoting assembly for location of the drilling tool and means for controlling the angle alpha formed between the two bodies.

11. The assembly claimed in claim 10, wherein said means for controlling the angle formed between the two bodies comprises a screw-jack means for adjusting a distance between a first point belonging to the lower body and a second point belonging to the upper body.

12. The assembly as claimed in claim 10, wherein the measuring probe is placed inside an internal centering body integral towards a top thereof with the base of the flexible portion of the orientation column and towards a bottom thereof with the upper body of the deflector means, wherein said internal centering body is centered inside an external centering body which is centered and aligned in a well by lower and upper centering shoes, said external centering body being integral at a top part thereof with a foot of a main flexible connection and connected at a bottom part thereof to the drilling tool by a drive spacer assembly comprising a rotary flexible joint.

13. The assembly, as claimed in claim 12, wherein centering and alignment of the internal centering body inside the external centering body and centering of the drive spacer about the lower and upper bodies of the deflector means are provided by at least three radial pivoting assemblies.

14. The assembly as claimed in claim 13 further comprises ducts at a foot of the main flexible connection and flexible bellows insulation about the deflector means for ensuring a flow of drilling sludge between heads of the centering body and the tool takes place solely in a central part of the assembly, and the radial pivoting assembly works in a clean medium lubricated by oil.

15. The assembly as claimed in claim 12, wherein longitudinal thrust and tractive forces between the main flexible connection and the drilling tools are transmitted through a central core formed by the internal centering body, the deflector means and the tool axial pivoting assemblies at a head and at a foot of the central core.

16. The assembly as claimed in claim 15, further comprising ducts at a foot of the main flexible connection and flexible bellows insulation about the deflector means for ensuring that a flow of drilling sludge between heads of the centering module and the tool takes place solely in a central part of the device, and the axial pivoting assembly works in a clean medium lubricated by oil.

17. The assembly, as claimed in claim 2, further comprising means on the surface for orientating said orientation column.

* * * * *